United States Patent [19]

Dobias et al.

[11] Patent Number: 5,047,144

[45] Date of Patent: Sep. 10, 1991

[54] PROCESS FOR THE SEPARATION OF MINERALS BY FLOTATION

[75] Inventors: Bohnslav Dobiaš, Regensburg; Horst Michaud; Josef Seeholzer, both of Trostberg, all of Fed. Rep. of Germany

[73] Assignee: SKW Trostberg Aktiengesellschaft, Trostberg, Fed. Rep. of Germany

[21] Appl. No.: 412,596

[22] Filed: Sep. 26, 1989

Related U.S. Application Data

[63] Continuation of Ser. No. 170,060, Mar. 15, 1988, abandoned, which is a continuation of Ser. No. 866,239, May 21, 1986, abandoned.

[30] Foreign Application Priority Data

May 22, 1985 [DE] Fed. Rep. of Germany ..... 3518279
May 7, 1986 [DE] Fed. Rep. of Germany ..... 3615385

[51] Int. Cl.[5] ..... B03D 1/14

[52] U.S. Cl. ..... 209/166; 209/167; 252/61

[58] Field of Search ..... 209/166, 167; 252/61

[56] References Cited

U.S. PATENT DOCUMENTS

| | | | |
|---|---|---|---|
| 2,187,930 | 1/1940 | Brown | 209/167 |
| 3,017,028 | 1/1962 | Schoeld | 209/167 |
| 3,582,461 | 6/1971 | Lipowski | 162/72 |
| 3,819,048 | 6/1974 | Weimer | 209/166 |
| 3,990,965 | 11/1976 | Csillag | 209/166 |
| 4,078,993 | 3/1978 | Griffith | 209/167 |
| 4,128,475 | 12/1978 | Wang | 209/166 |
| 4,208,487 | 6/1980 | Wang | 209/166 |
| 4,514,292 | 4/1985 | Burdick | 209/167 |

FOREIGN PATENT DOCUMENTS

| | | | |
|---|---|---|---|
| 932485 | 8/1973 | Canada | 209/166 |
| 474357 | 3/1973 | U.S.S.R. | 209/167 |
| 607599 | 5/1978 | U.S.S.R. | 209/167 |
| 642000 | 1/1979 | U.S.S.R. | 209/167 |
| 876171 | 10/1981 | U.S.S.R. | 209/167 |
| 959830 | 9/1982 | U.S.S.R. | 209/167 |
| 998345 | 2/1983 | U.S.S.R. | 209/167 |
| 2175226 | 11/1986 | United Kingdom | 209/166 |

OTHER PUBLICATIONS

Hawley's Chemical Condensed Dictionary 11th edition, published 1987, by Van Nostrand Reinhold, p. 304.

*Primary Examiner*—Stanley S. Silverman
*Assistant Examiner*—Robert J. Popovics
*Attorney, Agent, or Firm*—Felfe & Lynch

[57] ABSTRACT

The present invention provides a process for the separation of minerals by flotation in the presence of activators and suppressors. Activators are cation-active condensation products and suppressors are anion-active products of aminoplast formers, formaldehyde and amines, ammonium salts, acids or a sulphite, in combination with either an anion-active or cation-active tensides.

15 Claims, 2 Drawing Sheets

PROCESS FOR THE SEPARATION OF MINERALS BY FLOTATION

This is a continuation of application Ser. No. 170,060 filed on Mar. 15, 1988, which was a continuation of application Ser. No. 866,239 filed on May 21, 1986, both now abandoned.

FIELD OF THE INVENTION

The present invention is concerned with a process for the separation of minerals, such as for example mixtures from silicate minerals, coal from silicate and oxidic minerals but also heavy metal ores from types of gangue, by selective flotation.

BACKGROUND OF THE INVENTION

By weathering of feldspars, which represent about 60% of all minerals, there results kaolinite, the main raw material of the ceramic industry. However, kaolinite also finds use as a filler material in the production of paper and cardboard, as well as in the synthetic resin, rubber and dyestuffs industries. The need for kaolinite for these fields of use is continuously increasing.

Since kaolinite does not occur in nature in pure form but rather in an admixture with feldspar and quartz, a purification or enrichment is necessary since high demands of quality are placed on the product. The working up technique is of increasing importance since in the future the ratio of kaolinite to feldspar and quartz will become worse to the disadvantage of kaolinite. Furthermore, besides substantially pure kaolinite, the working up process is also to provide feldspar in high concentration.

In the case of the flotation of kaolinite, there are used, inter alia, quarternary ammonium compounds as cationic-active collectors. These have a strongly toxic effect on living organisms, are not broken down biologically and, in addition, require a pH value higher than 3 and thus considerable amounts of acid.

The recovery of feldspar from the minerals used for obtaining kaolinite has, in the meantime, achieved worldwide importance. Hitherto, the flotation of these minerals has only been satisfactory with a combination of flotation agents containing hydrofluoric acid.

Besides the disadvantage of the use of cationic collectors, which is not without problems with regard to their toxicity, there is the additional problem of having to work with the toxic and corrosive hydrofluoric acid.

Thus, there is a need to develop a process which avoids the disadvantages of the previously known flotation processes for the separation of minerals or which makes possible a separation of types of gangue from ores and coal and permits the achievement of high yields of pure products.

SUMMARY OF THE INVENTION

This task is solved by the use of cationic or anionic condensation products of aminoplast formers, formaldehyde and amines, ammonium salts, acids or a sulphite acting as activators and suppressors, in combination with anionic or cationic active tensides. That is, a cationic condensation product combined with an anionic-active tenside acts as an activator and a cationic condensation product combined with a cationic-active tenside acts as a suppressor. An anionic condensation product and anionic-active tenside act as a suppressor, while an anionic condensation product and cationic-active tenside act as an activator.

It is surprising that in the case of the flotation separation of feldspar from kaolinite, the se of cationic-active condensation products of aminoplast formers with formaldehyde as activators, in combination with anion-active non-toxic collectors which can be broken down biologically, gives rise to highly enriched products under only moderately acidic to basic pH conditions (pH values of from 3 to 10).

Thus, for example, from feldspar/kaolinite/quartz mixtures with a kaolinite content of from 50 to 55% by weight, in the case of the use of a cation-active dicyandiamide-formaldehyde condensation product, there can be obtained in the first flotation a kaolinite concentrate with a content of more than 80% by weight of kaolinite which, by means of a second flotation procedure, can be enriched to more than 90% by weight kaolinite. In this way, in the minerals, the residual content of kaolinite can be reduced to less than 4% by weight. The separation of feldspar and quartz also takes place in an outstanding manner in the case of the use of a cation-active dicyandiamide-formaldehyde condensation product as activator in combination with an anionic tenside as collector.

In the case of a first flotation from minerals with a proportion containing 50% by weight of feldspar, there is achieved an enrichment to about 80% by weight feldspar which, by subsequent purification, can be brought to a content of over 90% by weight. Thus, according to the present invention, it is possible completely to omit the previously necessary use of hydrofluoric acid, as well as of a part of the amount of sulphuric acid since working is carried out in a less strongly acidic pH range.

From a mineral consisting of kaolinite, feldspar and quartz with a proportion of kaolinite of about 55% by weight, by means of the addition of a suppressor according to the present invention based on a cation-active dicyandiamide, urea or guanidine-formaldehyde condensation product and of a cation-active tenside as collector, in a weakly basic pH range up to a pH value of about 8.5, i.e., without the addition of acid, the kaolinite can be enriched in one flotation step to more than 85% by weight.

As activator- or suppressor-acting cation-active condensation products of aminoplast formers with formaldehyde, there can be used compounds which, as aminoplast former, contain a compound of the general formula:

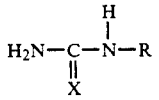

wherein R is hydrogen atom or a cyano or carbamide group and X is an imino group or an oxygen atom. Thus, based on dicyandiamide, urea, guanidine or guanylurea, condensation products based on dicyandiamide being preferred, there is an activator effect. These condensation products are produced by the reaction of the aminoplast former with 1.0 to 4 moles of formaldehyde in the presence of an inorganic or organic acid, as well as possibly of an ammonium or amine salt.

These products have a low molecular weight and are miscible with water in all proportions. Their aqueous solutions have pH values of from 2 to 6. Such condensation products are widely described in the patent literature, for example in Federal Republic of Germany Patent Specification No. 19 17 050, as well as in U.S. Pat. Nos. 3,491,064 and 3,582,461. For the control of special separation problems, under certain circumstances, it can prove to be advantageous to use a combination or a mixture of cation-active condensation products based on various aminoplast formers, such as for example dicyandiamide, guanidine and urea. By the use of these condensation products in an amount of 1 to 1000 g. and preferably of from 60 to 600 g. per tonne of flotation material, the flotation is also successful in the case of minerals whose spectrum lies within the finest grain range, i.e., 1 to 1 μm.

Anion-active tenside based on comparatively long-chained alkyl sulphonates or sulphates, arylsulphonates or alkylarylsulphonates are used as collectors for the flotation. They can be used in an amount of from 50 to 1000 g. per tonne of material to be subjected to flotation, the preferred amount being from 400 to 800 g. per tonne.

Cation-active tensides have already been suggested as adjuvants for the flotation of silicates. In most cases, they are organic alkylamines wherein the non-polar organic radical carries, in the case of salt formation, an ammonium ion as polar group.

Surprisingly, the combination of a cation-active condensation product of an aminoplast former with formaldehyde, amines, ammonium salts and possibly of an acid, in combination with an anion-active or cation-active tenside as collector, is an outstandingly effective system for the separation of feldspar from other silicate mineral components although, according to previous knowledge, a flotation with anion-active collectors in the whole range above pH 2 was not to have been expected (see. P. Ney, "Zeta-Poentiale und flotierbarkeit van ZMineralien", pub. Springer Verlag, Vienna—N.Y., 1973, page 155, paragraph 4).

Furthermore, it has, surprisingly, been shown that by means of the use of anion-active condensation products as activators based upon melamine, guanamines, dicyandiamide, guanidine or urea, in combination with a cation-active tenside, thereis possible an outstanding flotation separation of silicate accompanying materials from industrially interesting ores.

Such anion-active condensation products are obtained by the reaction of the aminoplast former with 1 to 4 mole of formaldehyde and 0.5 to 3 mole of a sulphite, in which case bisulphite, dithionite or a sulphonic acid are preferably used in the form of an alkali metal salt. Melamine and dicyandiamide have proved to be especially suitable as aminoplast formers in which they are reacted with 1.5 to 3 moles of formaldehyde and 0.5 to 1.5 moles of sodium bisulphite.

The outstanding suitability of the condensation products according to the present invention, which are cation-active and are based upon aminoplast former, formaldehyde and ammonium salt (cf. the following Example 1A), is shown by the differing speed of migration of various minerals in the case of electrophoresis.

DETAILED DESCRIPTION OF THE PREFERRED EMBODIMENTS

Figure 1:
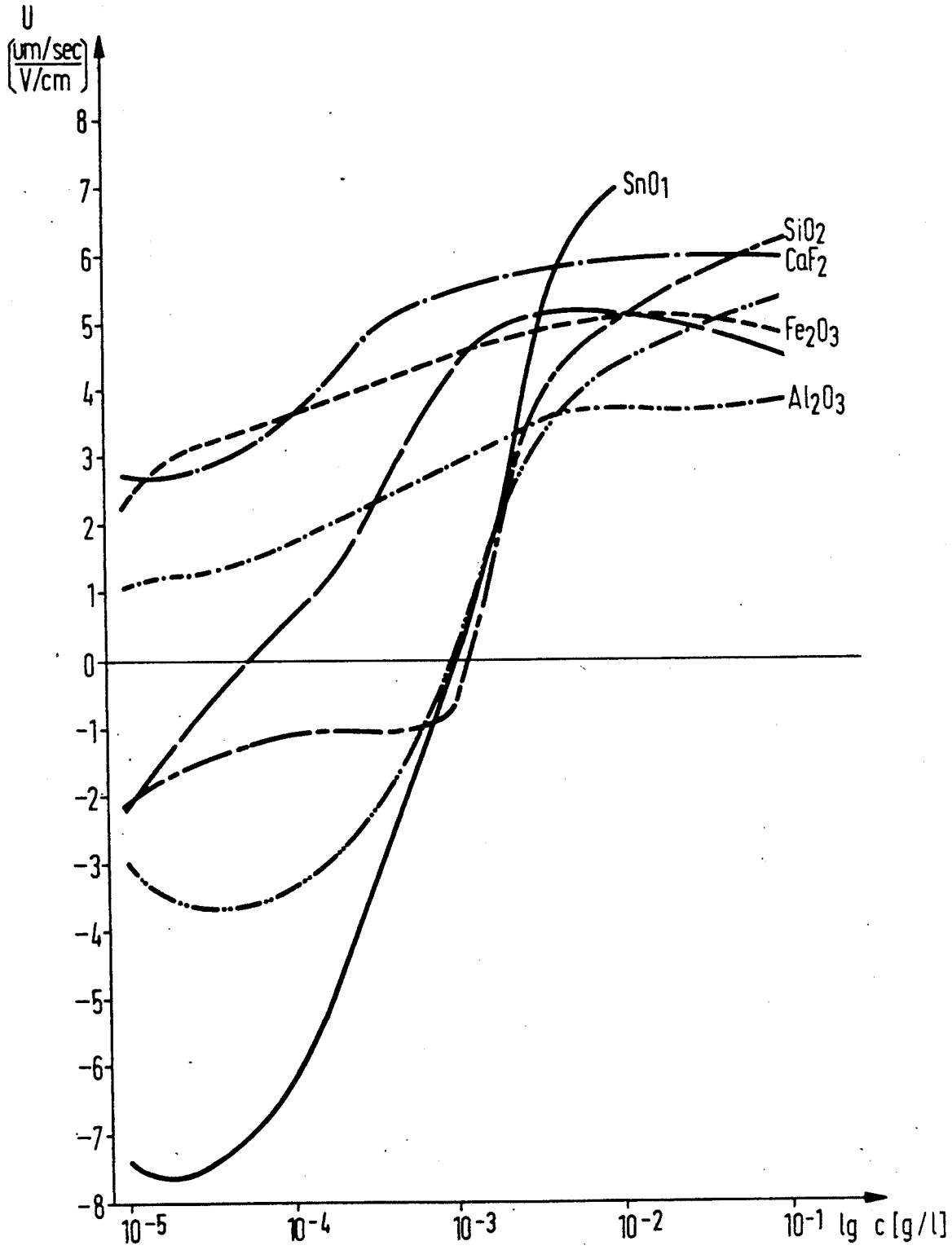
FIG. 1 is a graph illustrating the speeds of migration of particular minerals depending on the concentration of a cation-active condensation product.

FIG. 1 of the accompanying drawings shows the speeds of migration of tin dioxide, silicon dioxide, fluorspar, apatite, ferric oxide, calcite and aluminum oxide in dependence upon the concentration of the cation-active condensation product. As a result of the differingly strong deposition of the condensation product on the surfaces of the different mineral particles, these receive differing electric charges and can, therefore, be separated by flotation in combination with suitable tensides. This figure clearly shows the possibility of separating calcite from a mixture with tin dioxide at a concentration of $2\times10^{-4}$ g./liter of cation-active condensation product based on dicyandiamide as aminoplast former.

By the use of an anion-active condensation product based upon melamine, formaldehyde and sulphite (cf. Example 1H) in a concentration of $10^{-1}$ g./liter, it is possible, for example, to carry out the separation of coal from minerals in a weakly alkaline pH range in which the coal coagulates and the mineral portion remains in suspension.

By means of the measurement of the zeta potential of various mineral suspensions which have been mixed with anion-active or cation-active condensation products based on aminoplast formers, there could be obtained a measure for the absorption ability of the minerals for these condensation products and thus there is obtained an indication for the possibility of separation of various ores from accompanying minerals.

The combinations according to the present invention of cation-active or anion-active condensation products based on aminoplast formers with formaldehyde, amines, ammonium salts or acids or with bisulphite and anion-active or cation-active tensides have proved to be useful, for example, in the case of the separation of feldspar/quartz mixtures, calcite/ apatite, scheelite/-fluorite, iron oxide/quartz, spodumene or tourmaline/-quartz, cassiterite, niobium and tantalum ores from accompanying minerals or feldspar, kaolinite and quartz mixtures, as well as possibly mixtures of sparingly-soluble minerals of the salt type.

The following Examples, which are given for the purpose of illustrating the present invention, demonstrate the outstanding action of the system according to the present invention on the basis of various minerals.

EXAMPLE 1

Condensation Product Preparation

A. Cation-active condensation product from dicyandiamide, formaldehyde and ammonium chloride (mole ratio 1:20.0:0.75)

101.9 parts by weight of ammonium chloride and 119.5 parts by weight of dicyandiamide are introduced at ambient temperature in 357.5 parts by weight of 30% formal in. The suspension is heated to 60° C, whereafter, without the further supply of heat, the temperature rapidly increases further to the boiling point. The reaction mixture is maintained at a gentle boil for a further 3 hours. The solids content of the condensation product is 50% by weight.

B. Cation-active condensation product from dicyandiamide, formaldehyde and hydrochloric acid (mole ratio 1:20.2:009)

84 parts by weight of dicyandiamide are stirred with 60 parts by weight of 32% hydrochloric acid and, after commencement of a temperature increase, a further 54 parts by weight of hydrochloric acid are added dropwise thereto, the temperature of the mixture thereby increasing to 110° C. After subsidence of the exothermic reaction, 200 parts by weight of 30% formal in are added thereto within the course of 10 minutes, whereby the temperature should amount to 90 to 95° C. After termination of the addition of the formal in, further condensation is carried out for 5 hours at 95° C. The product obtained contains 45% of solid material.

C. Cation-active condensation product from dicyandiamide, formaldehyde and formic acid (mole ratio 1:3:0.25)

84 parts by weight of dicyandiamide and 12.7 parts by weight of 85% formic acid are introduced at ambient temperature into 250 parts by weight of 36% formaldehyde. The reaction mixture is stirred for 90 minutes at 20 to 25° C., heated for 60 minutes to 60° C. and finally heated under reflux for 10 minutes. Upon cooling, 50 parts by weight of methanol are added to the solution upon reaching 55° C. The solution has a solids content of about 42%.

D. Cation-active condensation product from dicyandiamide, formaldehyde, ammonium chloride and ethylenediamine (mole ratio 1:2.25:0.82:0.1)

239 parts by weight of dicyandiamide, 123 parts by weight of ammonium chloride and 17.4 parts by weight of 99% ethylenediamine are stirred at ambient temperature into 627 parts by weight of 30% formal in. Due to the exothermic reaction, the reaction mixture automatically heats up to 80 to 90° C. Further condensation is carried at 90° C. for 10 minutes, whereafter the reaction mixture is cooled. The solids content of the product is 50%.

E. Cation-active condensation product from urea, formaldehyde and ammonium sulphate (mole ratio 1:4:0.45)

A mixture of 111.9 parts by weight 30% formal in, 8.1 parts by weight paraformaldehyde and 20 parts by weight of ammonium sulphate is heated to 90° C. 20 parts by weight of urea are introduced with the course of 15 minutes and the solution is stirred for 4 hours at 92° C. After cooling, the solids content of the condensation product is found to be 45%.

F. Cation-active condensation product from guanidine, formaldehyde and ammonium chloride (mole ratio 1:1.2:1.1)

81 parts by weight guanidine hydrochloride and 50 parts by weight of ammonium chloride are dissolved at ambient temperature, while stirring, in a mixture of 100 parts by weight of 30% formal in and 225 parts by weight of water. The solution is kept at a gentle boil for 4 hours. The resulting condensation product has a solids content of 41% by weight.

G. Anion-active condensation product from dicyandiamide, formaldehyde and sulphite (mole ratio 1:2:1)

820 parts by weight of dicyandiamide and 950 parts by weight of sodium bisulphite are stirred at ambient temperature in 2000 parts by weight of 30% formal in. While carefully heating, the temperature is slowly increased to the reflux temperature (101° C.), maintained at this temperature for 120 minutes and thereafter cooled to ambient temperature. The solids content of the condensation product is 67% by weight.

H. Anion-active condensation product from melamine, formaldehyde and sulphite (mole ratio 1:2.75:1)

60 parts by weight of melamine are stirred into 131.2 parts by weight of 30% formal in. The mixture is heated to 80° C. for 30 minutes. Subsequently, it is cooled to 45° C. and 48 parts by weight sodium bisulphite, 12.9 parts by weight 20% aqueous sodium hydroxide solution and 68 parts by weight of water are added to the solution. It is again heated to 80° C. and condensed at this temperature for 35 minutes. After cooling to 65° C., 240 parts by weight of water are added thereto and the pH adjusted to 3.2 with a solution of 16.8 parts by weight of concentrated sulphuric acid and 133 parts by weight of water. The solution is finally condensed for 120 minutes at 70° C. After cooling to ambient temperature, the pH value is adjusted to 8.5 with 47.5 parts by weight of 20% aqueous sodium hydroxide solution. The solution of the condensation product has a solids content of 20% by weight.

EXAMPLE 2

Flotation Experiments 2.1. Flotation of a mineral of kaolinite, feldspar and quartz with an activator A mineral, the grain size of which lies in the finest grain range (90% smaller than 10 μm.) and which consists of kaolinite, feldspar and quartz, has a kaolinite content of 55.1% by weight (calcination loss 7.69%). It is floated in a Humboldt-Wedag cell under the following conditions:

250 g. of the mineral are slurried in 1 liter of water (7° German hardness) and the pH value adjusted to 3.0 by the addition of 3.6 ml 1N sulphuric acid. After the addition of one of the condensation products described above under A to F, the mineral is activated by stirring for 5 minutes, whereafter the collector is added and the mineral subsequently floated by the introduction of air.

The amount of the added cation-active condensation product is such that 80 g. of condensation product (as 100% product) is present per tonne of material. As anionic tenside, there is used an alkylaryl sulphonate (Maranil A 55 of the firm Henkel). The amount of the tenside is 840 g. per tonne of mineral. The floating kaolinite is drawn off and dried. The content of the concentrate obtained is determined by determination of the calcination loss.

The concentrations of the cation-active condensation product and of the tenside are kept constant during the whole of the flotation time by adding, with the added supplementary water, the percentage equal amounts of condensation product and tenside.

The results of the experiments carried out under comparable condition are summarized in Table I. By the addition o f very small amounts of flotation adjuvant, already in the the case of the first flotation there are obtained kaolinite contents of at least 85%.

TABLE I

Flotation in a Moderately Acidic Medium (pH 3)

| Cationic Condensation Product Type | Use of 250 g. Mineral | Concentrate 1 | Concentrate 2 | Concentrate 3 | Residual Feldspar-Quartz |
|---|---|---|---|---|---|
| A | discharge g. | 105.14 | 29.48 | 37.22 | 69.7 |
| | kaolinite conc. % | 85.6 | 86.7 | 60.3 | 3.9 |
| | kaolinite yield % | 67.6 | 10.2 | 16.9 | 2.0 |
| B | discharge g. | 52.07 | 26.40 | 20.39 | 148.9 |
| | kaolinite conc. % | 91.1 | 91.4 | 86.7 | 35.1 |
| | kaolinite yield % | 34.8 | 17.7 | 13.0 | 38.3 |
| C | discharge g. | 81.24 | 25.46 | 18.84 | 119.7 |
| | kaolinite conc. % | 87.4 | 88.2 | 87.6 | 25.9 |
| | kaolinite yield % | 52.6 | 16.6 | 16.5 | 22.9 |
| D | discharge g. | 58.24 | 37.33 | 35.47 | 115.1 |
| | kaolinite conc. % | 88.0 | 88.3 | 78.9 | 23.3 |
| | kaolinite yield % | 37.8 | 24.3 | 20.6 | 19.8 |
| E | discharge g. | 65.44 | 26.74 | 16.31 | 140.5 |
| | kaolinite conc. % | 86.4 | 89.6 | 85.6 | 34.7 |
| | kaolinite yield % | 41.3 | 17.5 | 10.2 | 35.1 |
| F | discharge g. | 50.40 | 26.95 | 18.18 | 149.8 |
| | kaolinite conc. % | 88.1 | 90.2 | 85.9 | 38.6 |
| | kaolinite yield % | 32.8 | 18.0 | 11.6 | 33.9 |

2.2. Flotation of a mineral of kaolinite feldspar and quartz With a suppressor

Under the same conditions as are described in Example 2.1, there is floated the same mineral in the same cell but with the use of a cation-active tenside. The amount of the cation-active condensation product is 80 g. per tonne of mineral and the amount of the cation-active tenside (Araphen G2D of the firm Henkel) is 527 g. per tonne. The automatically adjusted pH value is from 8.1 to 8.3

The results obtained with the individual cation-active condensation products acting as suppressors are given in the following Table II. Also in the case of the use of cation-active tensides as collectors, without the addition of acid, kaolinite contents of more than 85% are achieved by a single flotation.

TABLE II

Flotation in weakly basic medium (pH 8.1–8.3)

| cationic condensation product type | use of 250 g. mineral | concentrate 1 | concentrate 2 | residual feldspar + quartz |
|---|---|---|---|---|
| A | discharge g. | 94.26 | 63.09 | 105.37 |
| | kaolinite conc. % | 87.1 | 73.7 | 17.8 |
| | kaolinite yield % | 60.4 | 27.0 | 14.0 |
| B | discharge g. | 111.03 | 45.56 | 91.85 |
| | kaolinite conc. % | 86.1 | 69.2 | 13.5 |
| | kaolinite yield % | 69.8 | 23.0 | 9.1 |
| C | discharge g. | 106.56 | 30.76 | 109.03 |
| | kaolinite conc. % | 87.7 | 76.2 | 18.2 |
| | kaolinite yield % | 68.9 | 17.3 | 14.6 |
| D | discharge g. | 129.54 | 39.29 | 80.80 |
| | kaolinite conc. % | 80.6 | 61.8 | 18.2 |
| | kaolinite yield % | 75.9 | 17.7 | 10.7 |
| E | discharge g. | 96.88 | 30.89 | 119.02 |
| | kaolinite conc. % | 89.5 | 83.3 | 24.5 |
| | kaolinite yield % | 63.8 | 18.9 | 21.5 |
| F | discharge g. | 90.48 | 28.66 | 128.09 |
| | kaolinite conc. % | 90.5 | 86.1 | 23.5 |
| | kaolinite yield % | 60.1 | 18.1 | 22.1 |

2.3. Flotation of a feldspar quartz sand mixture with an activator 250 g. of a feldspar-quartz sand mixture (AKW-Hirschau), which cannot be further worked up wet mechanically, containing about 50% by weight of feldspar, are dispersed in 1.1 liters of water with 7° German hardness in a 1 liter flotation cell and the slurry adjusted to a pH value of 3.0 by the addition of sulphuric acid. As activator, there is used the cation-active condensation product described in Example 1 A) and as anion-active tenside an alkylaryl sulphonate (Maranil A 55 of the firm Henkel). The flotation is carried out in such a manner that activator and collector are added alternatingly until the feldspar no longer floats. There are added a total of 450 g. per tonne of tenside and a total of 650 g. per tonne of activator.

The concentration of the feldspar can, with the help of the process according to the present invention, be brought in one working step to more than 80% and, by post-flotation of the enriched material, to more than 90%.

2.4. Flotation of coal minerals with an anion-active condensation product

An aqueous 5% by weight coal dust suspension (Ensdorf/ Saar) is mixed with the anion-active condensation product 25 (according to Example 1H) commencing with $10^{-5}$ g./liter in increasing amounts, while stirring, and the deposition behavior observed. At a pH value of the suspension of about 8, the coal coagulated at a concentration of the condensation product of $10^{-1}$ g./liter and deposited, while the mineral portion remained in suspension. Thus, a selective separation of the coal is possible.

EXAMPLE 3

Migration speed of various minerals

Electrophoresis is dependent upon the concentration of cation-active condensation product.

The following minerals were investigated for their speed of migration in the presence of a cation-active condensation product according to Example 1A: tin dioxide, silicon dioxide, calcium fluoride, apatite, ferric oxide, calcite and aluminum oxide (see FIG. 1 of the accompanying drawings).

The mineral in question was investigated for its electrophoretic mobility as a 0.02% by weight suspension in the presence of $10^{-5}$ to $10^{-1}$ g./liter of cation-active condensation product in an electrophoresis apparatus (Mark II of Rank Brothers) at 20° C.

By the differingly strong deposition of the cation-active condensation product on the surface of the mineral particles, these receive a differing charge and can, in conjunction with suitable tensides, be separated from one another by flotation or coagulation. Thus, for example, the flotation of calcite from tin dioxide takes place satisfactorily with the help of the cationic condensation product according to Example 1A) optimally at a concentration of $2\times10^{-4}$ g./liter, in combination with an anion-active collector.

EXAMPLE 4

Influencing of the zeta potentials of minerals by means of anion-active condensation products

4.1. Apatite-fluorspar mixture

An aqueous suspension containing 0.02% by weight of finely ground apatite and fluorspar was mixed with increasing amounts of an anion-active condensation product produced according to Example 1G and based upon dicyandiamide as aminoplast former. The zeta potential was displaced increasingly in the negative region.

4.2. Zeta Potentials of Scheelite

An aqueous suspension containing 0.02% by weight of finely ground scheelite was mixed with increasing amounts of an anion-active condensation product as described in Example 1H. The zeta potential of the scheelite, which is in any case negatively charged, is displaced to even more negative values due to the adsorption of the anion-active condensation product.

Figure 2:
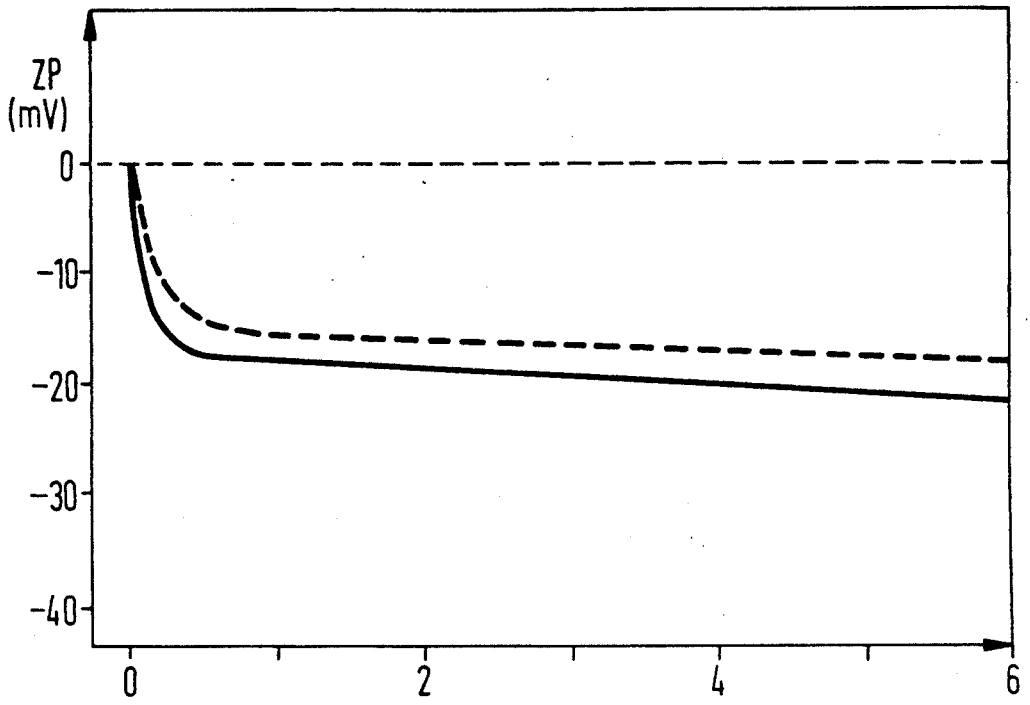
FIG. 2 is a graph illustrating the zeta potentials of particular minerals depending upon the concentration of two different anion-active condensation products.
Figure 2:
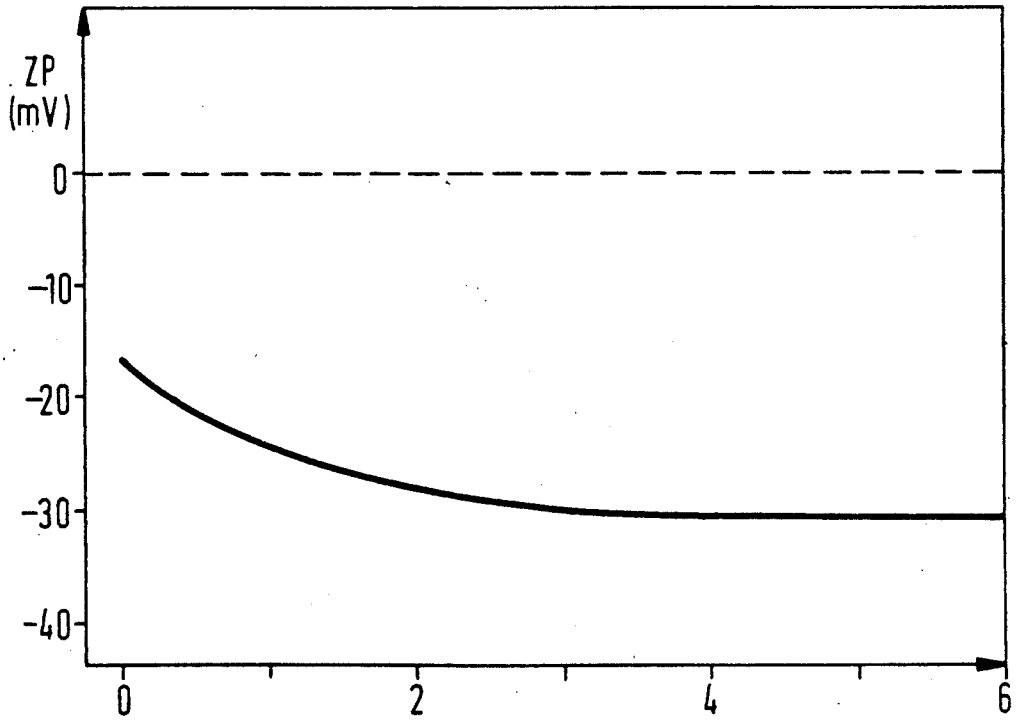

The measurements of the zeta potentials were, in every case, carried out with the laser microelectrophoresis apparatus Pen Kem 501 (see FIG. 2 of the accompanying drawings).

We claim:

1. In a process for the separation of minerals by flotation, the improvement comprising performing the flotation in the presence of a selecting agent which is an activator and in the presence of a tenside, wherein:
   - the selecting agent is miscible with water, has a pH of from 2 to 6 in aqueous solution, and is a cation-act rive condensation product formed by the condensation of (a) an dicyandiamide, (b) a formaldehyde, and (c) one of an amine, ammonium salt and an acid;
   - and the inside is an anion-active tenside having a member of the group of alkyl sulphonates, alkyl sulphates, arylsulphones and alkylaryl sulphonates.

2. The process of claim 1, wherein the the mole ratio of dicyandiamide to formaldehyde is form 1:1 to 1:4.

3. The process of claim 1 wherein the separation of minerals is carried out at a pH of from 3 to 10 using a combination of the cation-active condensation product and the anion-active tenside of the alkyl sulphonate or the akylaryl sulphonate.

4. The process of claim 1 wherein 1 to 1000 g. of he selecting agent of 50 to 1000 g. of the tenside is used per ton of mineral to be floated.

5. In a process of the separation of minerals by flotation, the improvement comprising performing the flotation at a pH of from 3 to 10 in the presence of from 50 to 1000 g of an anion-active tenside ton of mineral to be floated with a selecting agent miscible with water and having a pH of from 2 to 6 in aqueous solution the selecting agent being an activator which is a cation-active condensation product of formaldehyde, one of an amine, ammonium slat and an acid, and

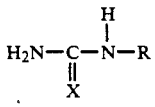

wherein R is hydrogen, cyano or carbamide and X is imino dicyandiamide in a mole ratio of dicyandiamide to formaldehyde of from 1:1 to 1:4.

6. In a process for the separator of minerals by flotation, the improvement comprising performing the flotation i the presence of a selecting agent which is a suppressor and in the presence of a tenside, wherein:
   - the selecting agent is miscible with water and is an anion-active condensation product formed by the condensation of (a) an aminoplast former, (b) a formaldehyde, and (c) one of a sulphite, bisulphite, dithionite, and an alkali metal salt of a sulfonic acid;
   - and the tenside is an anion-active tenside having a member of the group of alkyl sulphonates, alkyl sulphates, arysulphones and alkylaryl sulphonates.

7. The process of claim 6, wherein the aminoplast former is one of a group of dicyandiamide, guanidine, urea and melamine.

8. The process of claim 6 wherein the anion active condensation product is a condensation product of (a) melamine, dicyandiamide, urea or guanidine as the aminoplast former, (b) formaldehyde, and (c) one of a sulphite, bisulphite, dithionite and an alkali metal slat of sulphone acid; and the mole ratio of aminoplast former to formaldehyde to (c) is 1:1 to 4:0.5 to 3.

9. The process of claim 8 wherein the mole ratio of the aminoplast former to the formaldehyde to (c) is 1:1.5 to 3.0:0.5 to 1.5.

10. In a process for the separation of minerals by flotation, the improvement comprising performing the flotation at a pH of from 3 to 10 in the presence of from b 50 to 1000 g of an anion-active tenside per ton of mineral to be floated with a selecting agent being miscible with water, the selecting agent being a suppressor which is an anion-active condensation product of (a) melamine, dicyandiamide, urea or guanidine with (b) formaldehyde and with (c) one of a sulphite, bisulphite, dithionite and an alkali metal salt of sulphonic acid, in the mole ratio of 1:1 to 4:0.05 to 3.

11. In a process for the separation of minerals by flotation, the improvement comprising performing the flotation in the presence of a selecting agent which is an activator and in the presence of a tenside, wherein:
   - the selecting agent is miscible with water and is an anion-active condensation product formed by the condensation of (a) an aminoplast former, (b) a formaldehyde, and (c) one of a sulphite, bisulphite, dithionite, and an alkali metal salt of a sulfonic acid,
   - and the tenside is a cation-active tenside which is an organic alkylamine.

12. The process of claim 11, wherein the aminoplast former is one of a group of dicyandiamide, guanidine, urea and melamine.

13. The process of claim 11 wherein the anion-active condensation product is a condensation product of melamine, dicyandiamide, urea or guanidine as the aminoplast former, (b) formaldehyde, and one of a sulphite, bisulphite, dithionite and an alkali metal salt of sulphonic acid; and the model ratio of aminoplast former to formaldehyde to (c) is 1:1 to 4:0.5 to 3.

14. The process of claim 13 wherein the mole ratio of the aminoplast former to the formaldehyde to (c) is 1:1.5 to 3.0:0.5 to 1.5.

15. In a process for the separation of minerals by flotation, the improvement comprising performing the flotation at a pH of from 3 to 10 in the presence of from 50 to 1000 g of a cation-active tenside per ton of mineral to be floated with a selecting agent being miscible with water, the selecting agent being an activator which is an anion-active condensation product of (a) melamine, dicyandiamide, urea or guanidine with (b) formaldehyde and with (c) one of a sulphite, bisulphite, dithionite or an alkali metal salt of sulphonic acid in the mole ratio of 1:1 to 4:0.5 to 3.

* * * * *

UNITED STATES PATENT AND TRADEMARK OFFICE

CERTIFICATE OF CORRECTION

PATENT NO. : 5,047,144

DATED : September 10, 1991

INVENTOR(S) : Bohnslav Dobias, et al.

It is certified that error appears in the above-identified patent and that said Letters Patent is hereby corrected as shown below:

| | |
|---|---|
| Col. 3, line 39 | - "van ZMineralien" should read --von Mineralien--. |
| Col. 4, line 63 | - "formal in" should read --formalin--. |
| Col. 5, line 11 | - "formal in" should read --formalin--. |
| Col. 5, line 15 | - "formal in" should read --formalin--. |
| Col. 5, line 39 | - "formal in" should read --formalin--. |
| Col. 5, line 50 | - "formal in" should read --formalin--. |
| Col. 5, line 65 | - "formal in" should read --formalin--. |
| Col. 6, line 7 | - "formal in" should read --formalin--. |
| Col. 6, line 17 | - "formal in" should read --formalin--. |
| Col. 6, line 68 | - "o f" should read --of--. |
| Col. 8, line 31 | - "product 25 (according)" should read --product (according)--. |
| Col. 9, line 33 | - "cation-act rive" should read --cation active--. |
| Col. 9, line 37 | - "and the inside is" should read --and the tenside is--. |

UNITED STATES PATENT AND TRADEMARK OFFICE

CERTIFICATE OF CORRECTION

PATENT NO. : 5,047,144

DATED : September 10, 1991

INVENTOR(S) : Bohnslav Dobias, et al.

It is certified that error appears in the above-identified patent and that said Letters Patent is hereby corrected as shown below:

Col. 9, line 41 - "is form 1:1 to 1:4" should read --is from 1:1 to 1:4--.

Col. 9, line 57 - "ammonium slat" should read --ammonium salt--.

Col. 9, line 67 - "separator" should read --separation--.'

Col. 10, line 1 - "the flotation i" should read --the flotation in--.

Col. 10, line 17 - "metal slat" should read --metal salt--.

Col. 10, line 18 - "sulphone acid" should read --sulphonic acid--.

Col. 10, line 26 - "b 50 to 1000 g" should read --50 to 1000 g--.

Col. 10, line 52 - "the model ratio" should read --the mole ratio--.

Signed and Sealed this

Twenty-seventh Day of April, 1993

*Attest:*

MICHAEL K. KIRK

*Attesting Officer*

*Acting Commissioner of Patents and Trademarks*